US006536527B2

(12) United States Patent
Munk et al.

(10) Patent No.: US 6,536,527 B2
(45) Date of Patent: Mar. 25, 2003

(54) CONNECTION SYSTEM FOR CATENARY RISER

(75) Inventors: Brian N. Munk, Houston, TX (US); Rockford D. Lyle, Pinehurst, TX (US); Joseph W. Pallini, Tomball, TX (US); Glenn Wald, Spring, TX (US)

(73) Assignee: ABB Vetco Gray Inc., Houston, TX (US)

( * ) Notice: Subject to any disclaimer, the term of this patent is extended or adjusted under 35 U.S.C. 154(b) by 30 days.

(21) Appl. No.: 09/858,435

(22) Filed: May 16, 2001

(65) Prior Publication Data

US 2002/0009336 A1 Jan. 24, 2002

Related U.S. Application Data

(60) Provisional application No. 60/204,586, filed on May 16, 2000.

(51) Int. Cl.[7] ..... E21B 29/12; E21B 17/01

(52) U.S. Cl. ..... 166/345; 166/348; 166/341; 166/367; 405/224.2

(58) Field of Search ..... 166/348, 366, 166/349, 345, 359, 362, 341; 405/224, 224.2

(56) References Cited

U.S. PATENT DOCUMENTS

| | | | | | |
|---|---|---|---|---|---|
| 3,313,345 | A | * | 4/1967 | Fischer | 166/355 |
| 3,313,358 | A | * | 4/1967 | Postlewaite et al. | 166/355 |
| 3,421,580 | A | * | 1/1969 | Fowler et al. | 166/336 |
| 3,678,996 | A | * | 7/1972 | Herd | 166/368 |
| 3,701,261 | A | * | 10/1972 | Nolan, Jr. | 166/343 |
| 4,086,776 | A | * | 5/1978 | Beard | 114/258 |
| 4,127,005 | A | * | 11/1978 | Osborne | 114/265 |
| 4,422,507 | A | * | 12/1983 | Reimert | 166/348 |
| 4,456,070 | A | * | 6/1984 | Watkins | 166/344 |
| 4,808,034 | A | * | 2/1989 | Birch | 166/367 |
| 5,069,287 | A | * | 12/1991 | Short et al. | 166/339 |
| 5,088,556 | A | * | 2/1992 | Short et al. | 166/339 |
| 5,269,629 | A | * | 12/1993 | Langner | 166/367 |
| 5,279,369 | A | * | 1/1994 | Brammer | 166/345 |
| 5,291,902 | A | * | 3/1994 | Carman | 607/138 |
| 5,395,183 | A | * | 3/1995 | Watkins | 166/350 |
| 5,439,060 | A | * | 8/1995 | Huete et al. | 166/367 |
| 5,447,391 | A | * | 9/1995 | Gallaher et al. | 405/195.1 |
| 5,697,732 | A | * | 12/1997 | Sigmundstad | 141/279 |
| 5,794,700 | A | * | 8/1998 | Pollack | 166/339 |
| 5,881,815 | A | * | 3/1999 | Horton, III | 166/350 |
| 5,947,642 | A | * | 9/1999 | Teixeira et al. | 166/340 |
| 5,984,585 | A | | 11/1999 | Pallini, Jr. | 405/223.1 |
| 6,041,865 | A | * | 3/2000 | Knapp | 166/345 |
| 6,293,345 | B1 | * | 9/2001 | Watkins | 166/345 |
| 6,336,508 | B1 | * | 1/2002 | Guinn | 166/339 |
| 6,386,798 | B2 | * | 5/2002 | Finn | 166/359 |
| 6,422,316 | B1 | * | 7/2002 | Schutz et al. | 166/351 |
| 2001/0031174 | A1 | * | 10/2001 | Olivier et al. | 405/224.2 |

* cited by examiner

*Primary Examiner*—Thomas B. Will
*Assistant Examiner*—Thomas A. Beach
(74) *Attorney, Agent, or Firm*—Bracewell & Patterson, L.L.P.

(57) ABSTRACT

A connection between a riser and a receptacle of a floating platform may be preloaded to reduce fatigue. The platform has a receptacle with upper and lower grooved profiles. A hanger is connected to the upper end of the riser. The hanger has a latch that engages the lower grooved profile in the receptacle to resist downward pull of the riser. A tieback connection inserts from above into the receptacle. The tieback connection has an outer member that lands on the hanger. The outer member has a latch that engages the upper grooved profile. The tieback connection also has an inner member with a set of internal threads. Threads on the inner member engage threads on the latch, rotating the inner member relative to the outer member exerts an outward force on the tieback connection latch. As the latch is pushed into the tieback grooved profile, a downward preload force is created, which passes to the hanger latch. In another version, radial preload is provided by a deflectable lip that engages the receptacle below the hanger latch.

39 Claims, 7 Drawing Sheets

CONNECTION SYSTEM FOR CATENARY RISER

This invention claims priority from provisional application Ser. No. 60/204,586, filed May 16, 2000 for Connection System for Catenary Riser.

FIELD OF THE INVENTION

This invention relates in general to offshore drilling and production equipment, and in particular to an apparatus for connecting a riser to a platform.

BACKGROUND OF THE INVENTION

In subsea oil and gas wells, particularly in deep water, the wellheads will be located at the sea floor. Risers connect the wellheads or manifolds to a platform for drilling and production. A variety of systems are employed. In one, the platform floats and is anchored in place. Each wellhead has a riser that extends from the sea floor to the platform. In some systems, the risers will be supported at a lower deck level or keel on the platform, which may be beneath the surface of the sea. Each riser will be supported within a receptacle at the lower deck level or keel. A load shoulder in the receptacle supports the weight of the riser. A tieback connector is lowered from an upper deck level into the receptacle to provide a continuous conduit to the upper deck level.

In such systems, the platforms may be anchored such that the risers are curved in a catenary form. Currents and wave movements cause cyclic loading of the connection between the riser and the receptacle. This can result in fatigue damage to the connection.

SUMMARY OF THE INVENTION

In this invention, the connection apparatus is preloaded to resist fatigue damage. The receptacle at the platform has an upper shoulder and a lower shoulder. A hanger is attached to the riser, the hanger having a supporting shoulder that engages the lower shoulder to resist downward pull of the riser. In one embodiment, an upper member, which may be a tieback connector, lands in the receptacle above and in contact with the riser hanger. The upper member has a latch that engages the upper shoulder to prevent upward movement of the upper member. The upper member also has a tensioner that cooperates with the latch to exert a downward preload force on the supporting shoulder of the hanger.

In the first embodiment, the upper member has an outer member that carries a radially expandable latch and lands on the hanger. It also has an inner member that is carried within the outer member. The inner member has a locking surface that engages a locking surface on the latch. These locking surfaces are tapered and threaded in the preferred embodiment. Rotation of the inner member moves the inner member downward against the outer member, pushing the latch member outward. As the latch member moves into engagement with the upper shoulder, a downward force is exerted by the upper shoulder, which creates a downward acting preload that force against the hanger latch.

Alternately, the hanger may include a device for mitigating fatigue damage without an independent upper member. The preload member may comprise a radially deflectable lip mounted to the hanger below the supporting shoulder. The lip is forced into radial interference with the receptacle. In one embodiment, a hydraulically actuated wedge member is moved axially upward between the lip and the riser hanger to force the lip outward into engagement with the receptacle. In another embodiment, the lip is sized for radial interference as the hanger is pulled into the receptacle.

DETAILED DESCRIPTION OF THE INVENTION

Figure 1:
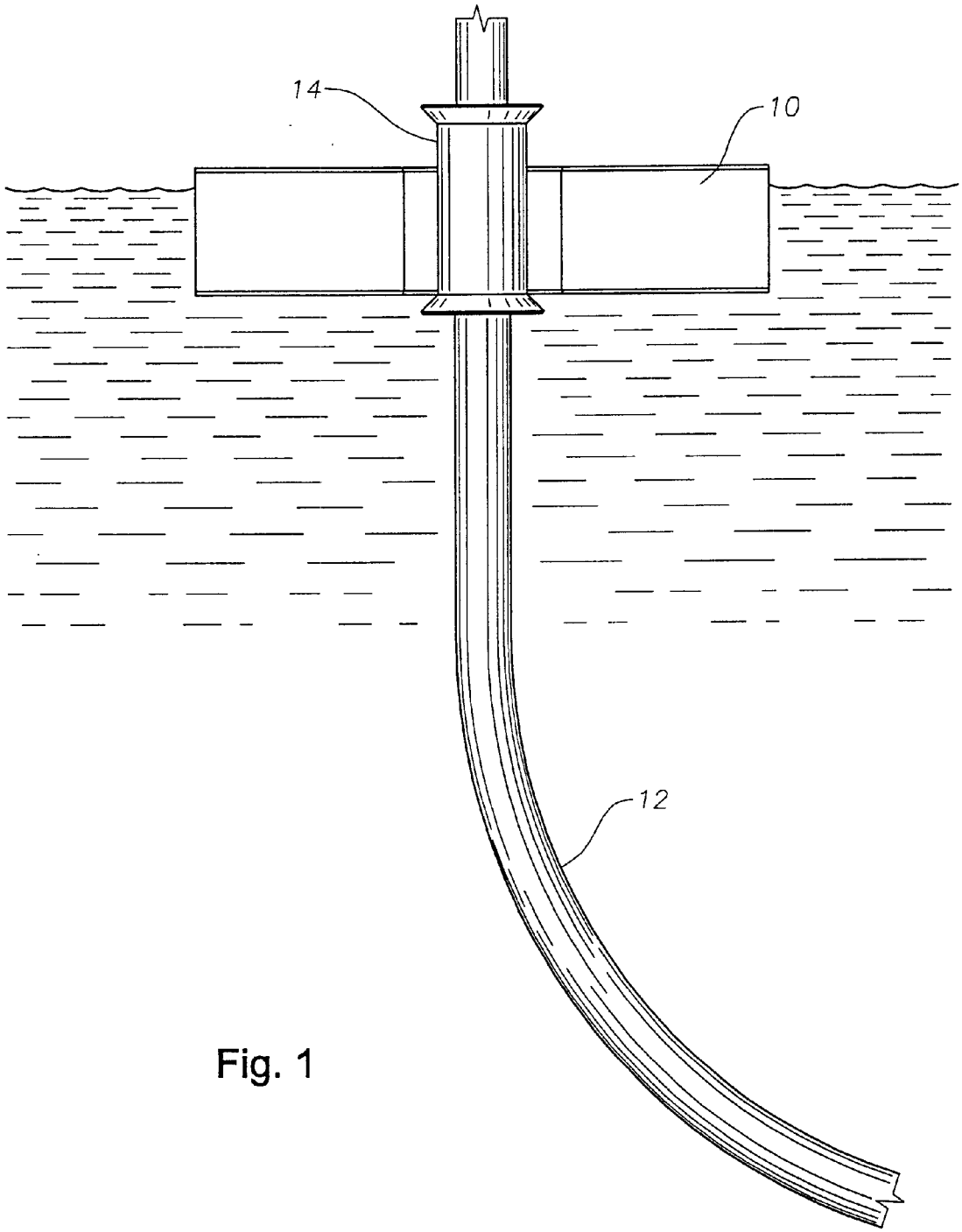
FIG. 1 is a schematic of a general catenary riser system extending from a platform.

Referring first to FIG. 1, a production vessel, tanker, or platform 10 for an offshore well is generally positioned on the ocean surface with one or more risers 12 extending downward to transport product to and from platform 10. Platform 10 will be anchored by lines (not shown), not by riser 12. Generally, risers 12 are catenary risers extending downward from the platform and curving in a catenary curve to extend horizontally at the sea floor or some intermediate point beneath the surface. However, it is not necessary to this invention that riser 12 be of a catenary type, rather it could be essentially vertical. Riser 12 is a tubular, pressure containing member connected at one end to the destination or source of the product to flow therethrough, such as a pipeline or Christmas tree (not shown)

Figure 2:
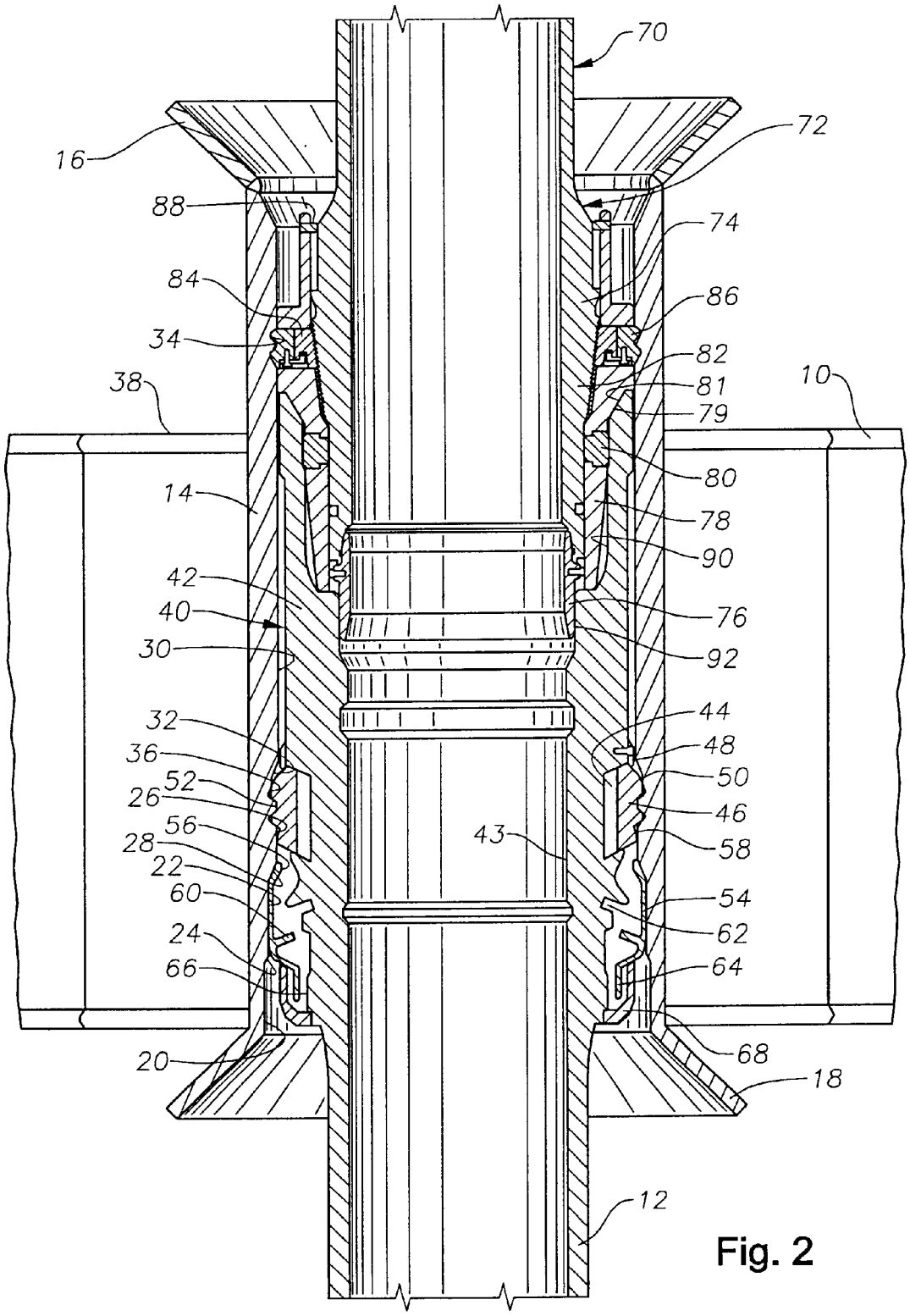
FIG. 2 is a cross-sectional view of a first embodiment of a connection system constructed in accordance with this invention in an engaged position.

Referring to FIG. 2, platform 10 has a catenary riser receptacle 14 positioned on its hull. Receptacle 14 is cylindrical having an upper conical end 16 and a lower conical end 18 which slope inwardly and toward receptacle 14. Conical ends 16, 18 help guide riser 12 and other lines into receptacle 14. The inner diameter of receptacle 14 is stepped into a plurality of diameters. In a preferred embodiment, there are four diameters, with a first and largest diameter 20 near the lower end of receptacle 14. A second, smaller diameter 22 is above the first diameter 20 and there is a first beveled transition 24 between the first and second diameters 20, 22. A third diameter 26 is smaller than and positioned above second diameter 22, and has a second beveled transition 28. The fourth diameter 30 is smaller than and positioned above third diameter 26, and has a third beveled transition 32. Fourth diameter extends for the remainder of receptacle 14.

Receptacle 14 has an upper shoulder comprising tieback engagement grooves 34 near its upper end and on the fourth diameter 30. A lower shoulder comprising riser engagement grooves 36 reside beneath tieback engagement grooves 34 on third diameter 26. Grooves 34 are generally triangular in the preferred embodiment, each having generally upward and downward facing flanks or shoulders that converge and join each other in a valley. Receptacle 14 may have stiffening members 38 on its outer diameter to stiffen receptacle 14 and facilitate mounting to platform 10.

The upper end of riser 12 is supported in receptacle 14 by a riser hanger 40. Riser hanger 40 has a tubular housing 42 with an axial bore 43 extending through it. Bore 43 has the same diameter as the riser 12. A recess 44 on the outer diameter of housing 42 slopes downward and inward. A split ring locking member or latch 46 resides in recess 44 and is biased outward and retained by a stop ring 48 secured to housing 42. Stop ring 48 engages an upper edge of latch 46. Latch 46 has an upper surface 50 that slopes downward and outward and is adapted to mate with transitions 28 and 32 and force latch 46 inward as it passes from a larger receptacle inner diameter to a smaller inner diameter, such as third diameter 26 to fourth diameter 30. Latch 46 also has a grooved profile 52 on its outer diameter adapted to engage the riser engagement grooves 36 of receptacle 14.

Latch 46 may be retained within recess 44 in a retracted position by a split ring retainer 54. Retainer 54 is axially and radially movable relative to housing and latch 46. Retainer 54 has an outer profile which generally mates with transitions 24, 28, and 32 and their respective diameters 20, 22, 26, and 30 to compress retainer to each diameter as it is drawn through receptacle 14. Retainer 54 also has a lip 56 on its upper end which extends inward and upward toward a corresponding profile 58 on latch 46. An internal rib 60 extends inward and upward from the inner diameter of retainer 54 and engages a slot 62 in housing 42. Retainer 54 also has a downwardly extending leg 64 which resides in a cavity 66 formed between the lower end of housing 42 and a cap 68. Cap 68 is joined to the lower end of housing 42 and extends upwardly concentric around housing 42. Retainer 54 is biased outward and radially retained against cap 58 by leg 54 when outside of receiver 14. Other similar retainer configurations will be readily apparent to one skilled in the art, and use of such other configurations are within the scope of this patent.

Figure 3:
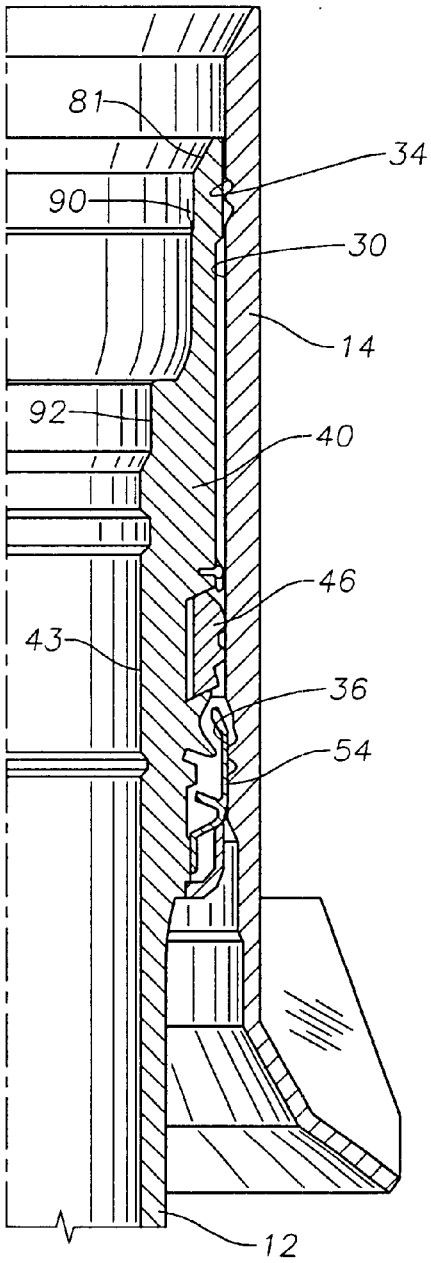
FIG. 3 is a cross-sectional view of the connection system of FIG. 2 wherein the hanger is in position to engage the receptacle.
Figure 4:
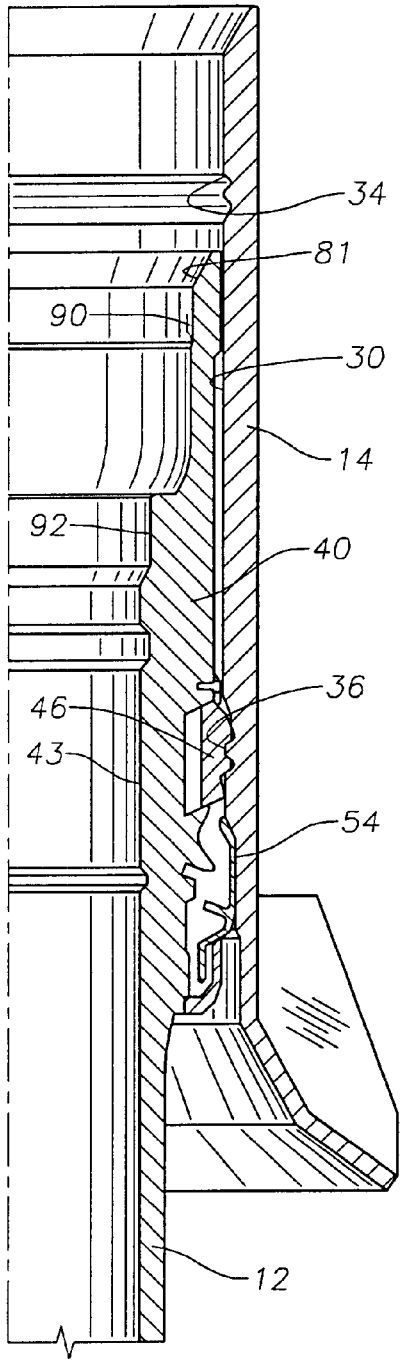
FIG. 4 is a cross-sectional view of the connection system of FIG. 2 wherein the hanger is in engagement with the receptacle.

Referring to FIGS. 3 and 4, riser hanger 40 can be drawn up through the bottom of receptacle 14 with a handling tool (not shown), so that latch 46 meets and passes grooves 36. Sloped upper surface 50 contacts second transition 28 and forces latch 46 inward, allowing latch 46 to slide into fourth diameter 30. Hanger 40 is then lowered, allowing latch 46 to expand in third diameter 26 and engaging groove profile 52 with riser grooves 36. Groove profile 52 and riser grooves 36 are biased to only support hanger 40 against downward movement, but slide out of engagement if hanger 40 is moved upward. In this locked position, retainer 54 resides in second diameter 22.

Figure 7:
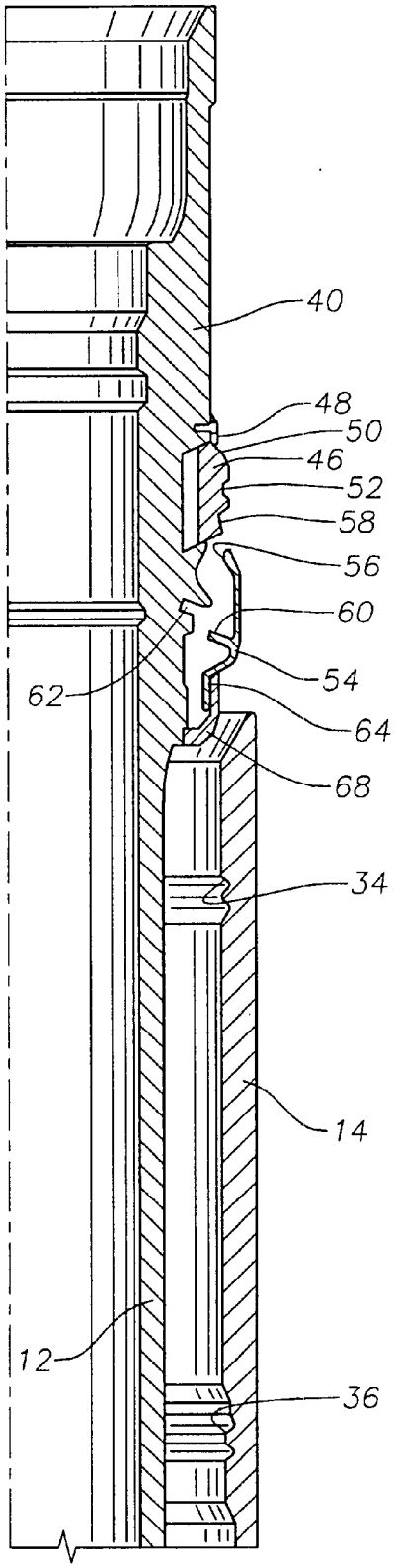
FIG. 7 is a cross-sectional view of the connection system of FIG. 2 wherein the hanger is being lifted above the receptacle.
Figure 8:
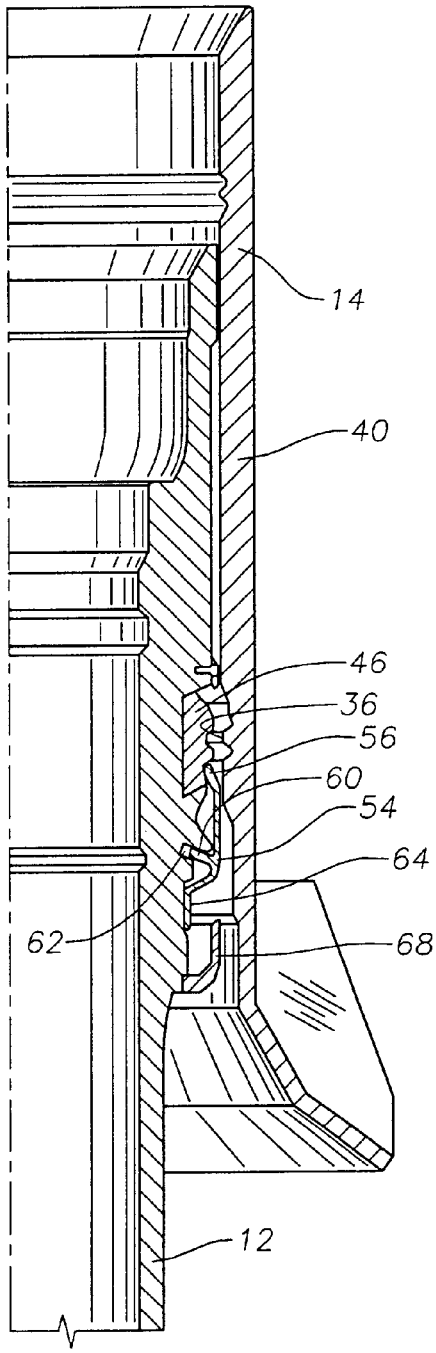
FIG. 8 is a cross-sectional view of the connection system of FIG. 2 wherein the retainer is preventing the hanger from engaging the receptacle.

Referring to FIGS. 7–8, hanger 40 can be released from the locked position described above and lowered out of receptacle 14 by first drawing hanger 40 upward out the top of receptacle 14. Sloped upper surface 50 contacts second transition 28 and forces latch 46 inward, allowing latch 46 to slide through fourth diameter 30. When hanger 40 exits the top of receptacle 14, latch 46 expands outward until it contacts stop ring 48. Retainer 54 expands outward until leg 64 contacts the inner diameter of cap 68. Hanger 40 is then lowered back into receptacle 14. The outer diameter of retainer 54 contacts fourth diameter 30 of receptacle 14, and retainer 54 is forced upward over latch 46. Lip 56 of retainer 54 overlaps the lower edge of latch 46, engaging profile 58 and internal rib 60 aligns over slot 62. As hanger 40 is lowered further into receptacle 14, retainer 54 is forced inward, which in turn forces latch 46 inward. Internal rib 60 in slot 62 ensures that retainer 54 does not override latch 46. Also, retainer 54 will abut the lower edge of profile 52 and prevent retainer 54 from overriding latch 46. When retainer 54 is fully within fourth diameter 30 and as it passes through the other diameters 26, 22, and 20, retainer 54 holds latch 46 out of contact with receptacle 14. Thus, grooved profile 52 on latch 46 does not engage riser grooves 36 on receptacle 14, and hanger 40 can be lowered out through the bottom of receptacle 14.

Latch 46 can be reset to re-engage riser grooves 36 on receptacle 14 by lowering hanger 40 out through the bottom of receptacle 14 and then lifting it back into receptacle 14. Retainer 54 will expand and be pulled downward away from and off of latch 46 as it contacts first diameter 20. Latch 46 will expand to contact receptacle 14 and is reset to re-engage riser grooves 36 as described above.

Figure 5:
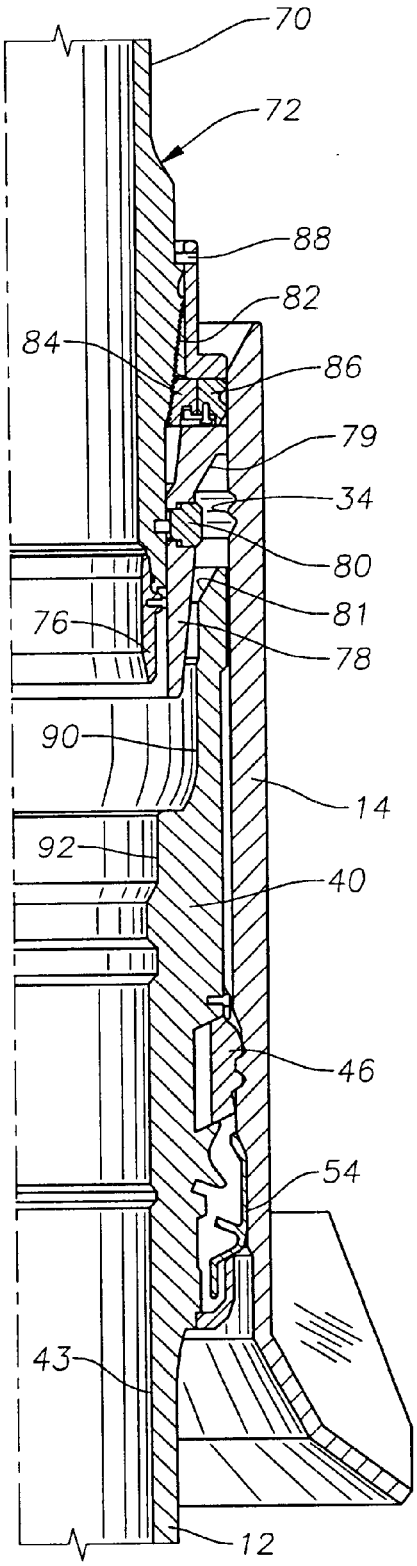
FIG. 5 is a cross-sectional view of the connection system of FIG. 2 wherein the tieback connector is being landed in the hanger and receptacle.
Figure 6:
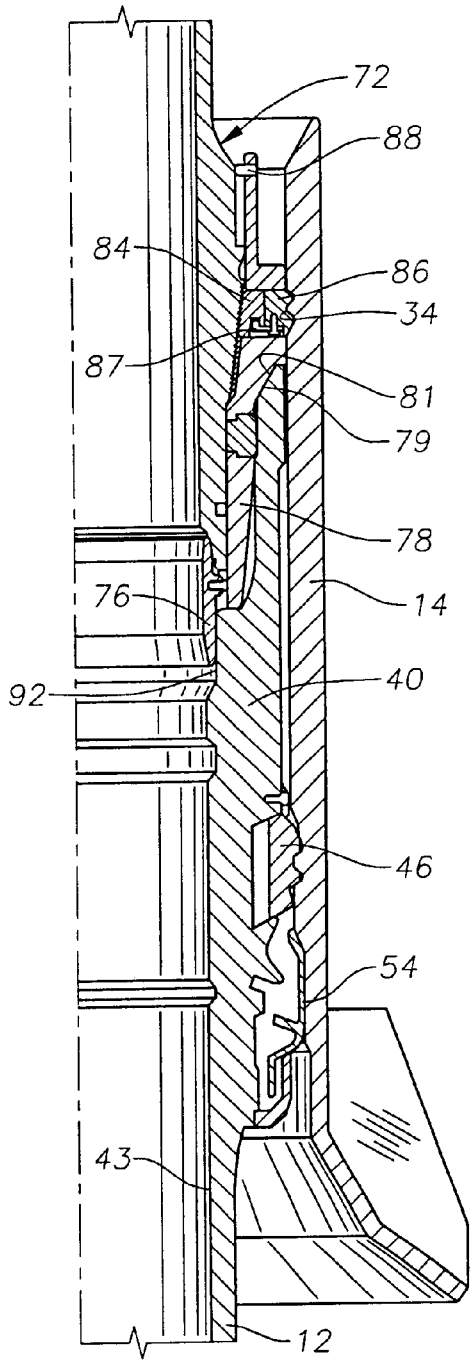
FIG. 6 is a cross-sectional view of the connection system of FIG. 2 wherein the tieback connector is in engagement with the receptacle and sealed with the hanger.

Referring to FIGS. 5 and 6, with hanger 40 locked into receptacle 14, a tubular member 70 can be joined with riser 12. Receptacle 14 is typically at a lower deck level on platform 10 (FIG. 1), normally below water. Tubular member 70 connects riser 12 with an upper deck level (not shown). Tubular member 70 has a tieback connector 72 on its lower end which inserts into hanger 40 and connects to receptacle 14. Tieback connector 72 has a tubular inner body or member 74, which serves along with other components as a tensioner to preload the engagement of hanger latch 46. Inner member 74 may be fitted with an annular metal seal 76 bolted to its lower end designed to make a metal to metal seal or an elastomer type seal. Seal 76 has the same inner diameter as the bore of tubular member 70 and tieback connector 72, as well as the nominal inner diameter of bore 43 of hanger 40.

A tieback connector outer member 78 is concentrically carried to slide axially on inner member 74, and is retained with inner member 74 by a ring 88. Outer member 78 is a sleeve that has an external downward and outward facing conical surface 79 that engages a mating conical rim 81 on the upper end of hanger 40. Outer member is prevented from rotating relative to hanger 40, once it lands, by anti-rotation pins 80. Pins 80 engage vertical slots formed in an upward facing receptacle 90 of hanger 40. A lower end of tieback outer member 78 is preferably spaced slightly above an upward facing shoulder in receptacle 90 of hanger 40 when conical surface 79 lands on hanger rim 81.

Inner member 74 has a conical threaded portion 82 on its exterior. A split dog ring 84 is carried within an annular internal recess in outer member 78. Dog ring 84 has threads on an inner conical surface that mate with the threaded portion 82. Conical threaded portion 82 slopes upward and outward. Split dog ring 84 carries a plurality of segments or dogs 86 joined to its outer diameter by retainers (FIG. 6), the dog ring 84 and dogs 86 serving as a latch to engage tieback grooves 34. Dogs 86 have grooved exteriors to engage tieback grooves 34 of receptacle 14. Dogs 86 protrude out of windows formed in outer member 78.

Hanger 40 and tieback connector 72 are dimensioned to provide a downward preload force on hanger latch 46. This dimensioning results in the upper ends of dogs 86 being initially slightly above the upper edge of tieback grooves 34 when tieback connector 72 first lands and prior to preloading. As the dogs 86 are pushed into tieback grooves 34, the inward and downward facing shoulders of grooves 34 will push downward on dogs 86, which in turn push downward on outer member 78. Outer member 78 transfers this downward preload force through surface 79 to rim 81 of hanger 40, which in turn transfers the force through latch 46 into receptacle 14.

As tubular member 70 is lowered onto hanger 40, tieback outer member 78 inserts concentrically into receptacle 90 of hanger 40 and lands on rim 81. When tieback outer member 78 lands on hanger 40, continued downward movement causes inner member 74 to move downward relative to outer member 78. Threaded section 82 will ratchet downward relative to split ring 84. This forces split ring 84 to expand radially outward, pushing dogs 86 into tieback grooves 34. At the same time, metal seal 76 inserts into a counterbore 92 of hanger bore 43, forming a metal-to-metal seal. The upward facing shoulder in receptacle 90 will be spaced a short distance below the lower end of inner member 74 and outer member 78, and seal 76 bridges this gap.

Tubular member 70 and connector inner member 74 are then rotated clockwise to preload the engagement of dogs 86 with tieback grooves 34 and apply a downward preload force on hanger latch 46. As inner member 74 rotates, outer member 78 is held against rotation by antirotation pins 80. The threaded section 82 will advance farther downward relative to dog ring 84, forcing dogs 86 more tightly into engagement with tieback grooves 34. Threaded section 82 will not contact the inner surface of outer member 78 at any point, rather a slight clearance will always exist. Because dogs 86 were initially slightly spaced above and out of alignment with grooves 34, the inward and downward facing shoulders of tieback grooves 34 exert a reactive downward and inward force on dogs 86 as dogs 86 move outward. Dogs 86 move downward slightly to align with tieback grooves 34, creating a compressive force that transmits through conical surface 79 of outer member 78 into rim 81 of hanger 40, which is an upper end of a neck surrounding receptacle 90 of hanger 40. This downward force is applied to hanger latch 46, which transmits it to receptacle 14. The downward force component thus preloads latch 46 in a downward direction.

The amount of downward deflection of outer member 78 and hanger rim 81 during preload is within the elastic range of the metal. To disengage connector 72, inner member 74 is rotated counterclockwise to unscrew it from dog ring 84, allowing dogs 88 to retract from engagement with grooves 34 when tieback connector 72 is pulled upward.

In operation, referring to FIGS. 3–8 in sequence, hanger 40 of catenary riser 12 is drawn up into receptacle 14 with a handling tool (not shown) so that latch 46 passes riser grooves 36 (FIG. 3). Hanger 40 is then lowered until latch 46 engages grooves 36 and is supported (FIG. 4). Since platform 10 is separately anchored, there is no buoyant force of the platform applying tension to riser 12. However, hanger grooves 36 must support the weight of riser 12.

Tieback connector 72 of tubular member 70 is then lowered into receptacle 90 of hanger 40 (FIG. 5). When tieback outer member 78 lands on rim 91, tieback inner member 74 will move downward relative to outer member 78, expanding dog ring 84 and causing dogs 86 to engage tieback grooves 34. Seal 76 will slide into counterbore 92 of hanger 40, forming a metal-to-metal seal. Tubular member 70 is then rotated in a first direction to cause inner member 74 to move further downward relative to outer member, pushing dogs 86 further outward into grooves 34, which force dogs 86 to move downward slightly. This causes deflection of the neck surround hanger rim 91, exerting a preload force through hanger housing 42, latches 46 and into receptacle 14.

When it is desired to disassemble the connection, tubular member 70 is rotated in a second direction to disengage dogs 86 from grooves 34. Tubular member 70 and tieback connector 72 are removed. Hanger 40 is then lifted upward, and latch 46 disengages from grooves 36. Hanger 40 is lifted above the top of receptacle 14 (FIG. 7) and lowered back in. Split ring retainer 54 impacts receptacle 14 and is forced up over latch 46, retaining latch 46 out of engagement with receptacle 14 and grooves 36 (FIG. 8). Hanger 40 is then lowered out the bottom of receptacle 14.

Figure 9:
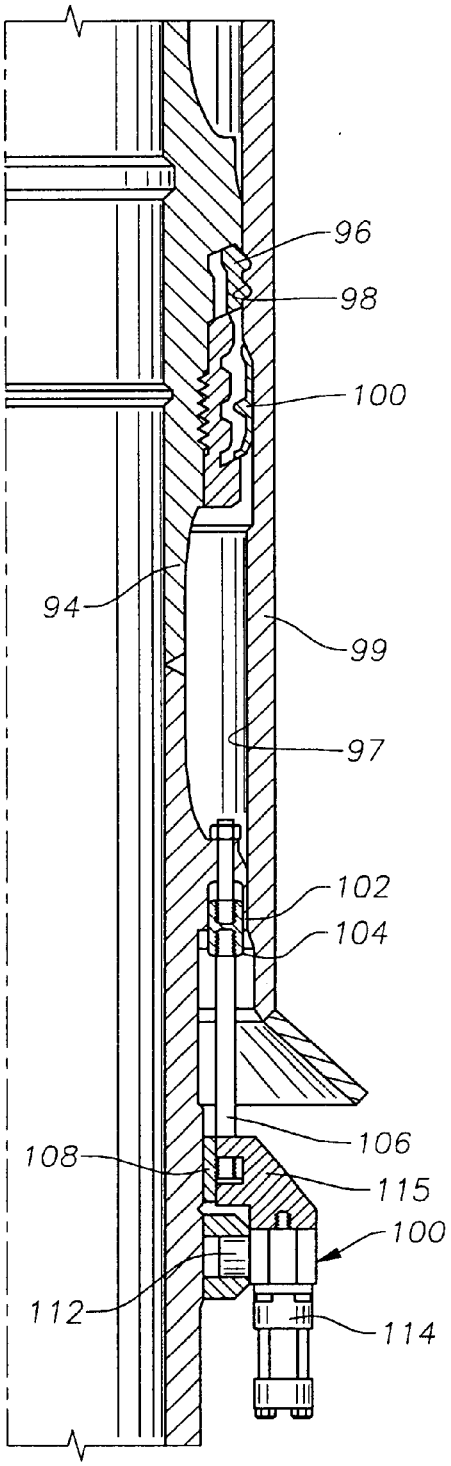
FIG. 9 is a cross-sectional view of a second embodiment of a connection system in accordance with this invention, showing the preload member in a disengaged position.
Figure 10:
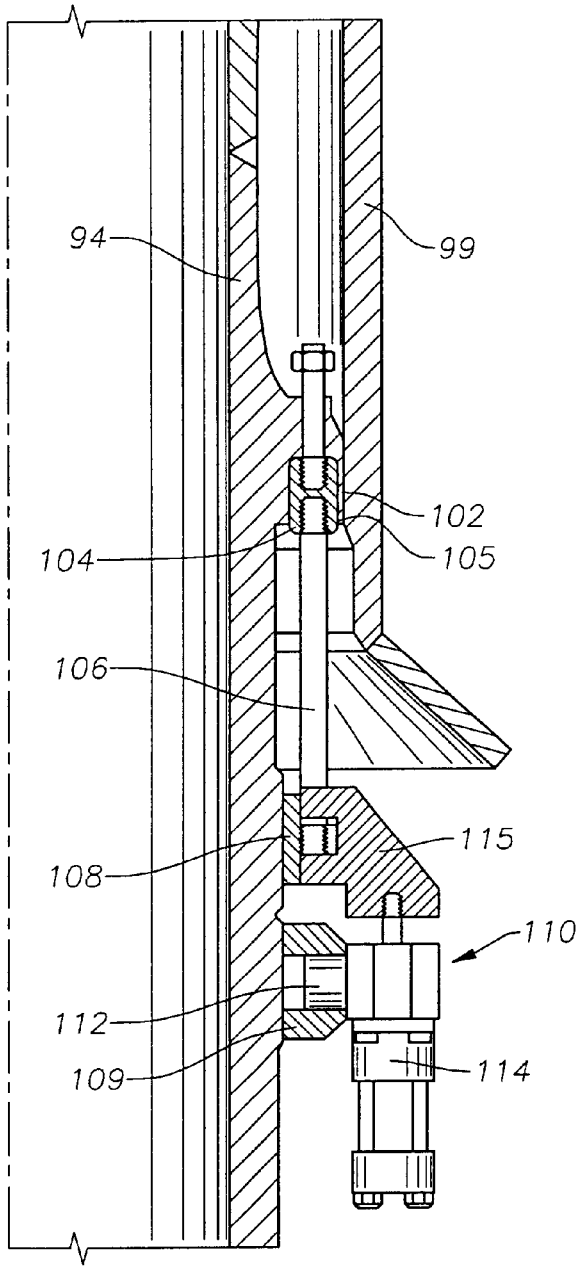
FIG. 10 is an enlarged cross-sectional view of the connection system of FIG. 9, showing the preload member in an engaged position.

In the embodiments of FIGS. 9–12, radial preloading is applied rather than axial preloading. Also, there is no separate tieback member lowered from above, rather the riser assembly extends to the upper deck. Referring to FIGS. 9 and 10, hanger 94 is not shown attached to the upper end of the riser, rather the riser will extend upward to an upper deck level. Hanger 94 has a latch similar in construction and operation to latch 46 of the first embodiment. Latch 96 is a split ring biased radially outward for snapping into grooves 98 in the inner diameter 97 of a receptacle 99. A latch retainer 100 located below latch 96 operates in the same manner as latch retainer 54 of the first embodiment.

A lip 102 is formed on the exterior surface of hanger 94 below latch 96. Lip 102 is spaced radially outward from the exterior surface of hanger 94 and depends downward. Lip 102 may be annular or a segment. Wedging block 104 is mounted to the exterior of hanger 94 for axial movement. Wedging block 104, which is preferably a segment, but could be annular, moves between the disengaged position of FIG. 9 upward to the engaged position of FIG. 10. Wedging block 104 has a cam surface on its outer surface that is tapered to provide a greater radial width at the lower end of block 104 than at the upper end. The lower end has a greater radial width than the width of the cavity between lip 102 and the exterior surface of hanger 94 when lip 102 is in its natural undeflected state. Moving block 104 upward into the cavity pushed lip 103 radially outward to radially preload it against the inner diameter 97 of receptacle 99. In the disengaged position, lip 102 is free to deflect radially back inward. In the disengaged position, the outer surface of lip 102 may be spaced slightly inward from the inner diameter 97 of receptacle 99. The deflection of lip 102 is preferably elastic, not permanent.

Wedging block 102 may be moved upward and downward by various devices. In the version shown in FIGS. 9 and 10, the actuator includes a plurality of rods 106 (only one shown) that are rigidly secured to block 102 and extend downward. Preferably they extend to a point below the lower end of receptacle 99 to allow access by an ROV (remote operated vehicle). Rods 106 are rigidly connected to an actuator ring 108, which is mounted to hanger 94 for axial sliding movement. A reacting ring 109 is rigidly attached to hanger 94 below actuator ring 108.

An actuator 110 may be removably mounted to reacting ring 109 by an ROV after langer latch 96 has engaged receptacle grooves 98. Actuator 110 has a pin 112 that slides into a hole in reacting ring 109 and a hydraulic cylinder 114. An engaging member 115 is mounted to the upper end of hydraulic cylinder 114. Engaging member 115 has an inward facing profile that engages actuator ring 108. When hydraulic fluid pressure is supplied, it strokes engaging member 115, actuator ring 108, rods 106 and wedging member 104 upward. The taper of cam surface 105 on wedging member 104 is a locking taper, allowing hydraulic pressure to be removed without wedging member 104 sliding downward. In this embodiment, the entire actuator 110 may be removed, leaving only actuator ring 108, reacting ring 109, rods 106 and wedging member 104. There will preferably be three or more assemblies or rods 106 and wedging members 104 spaced circumferentially around hanger 94. These assemblies would have been installed permanently at the surface. Hydraulic fluid pressure may be delivered by the ROV or from the upper deck of the platform. A permanently installed actuating assembly to move wedging block 104 could also be employed.

Figure 11:
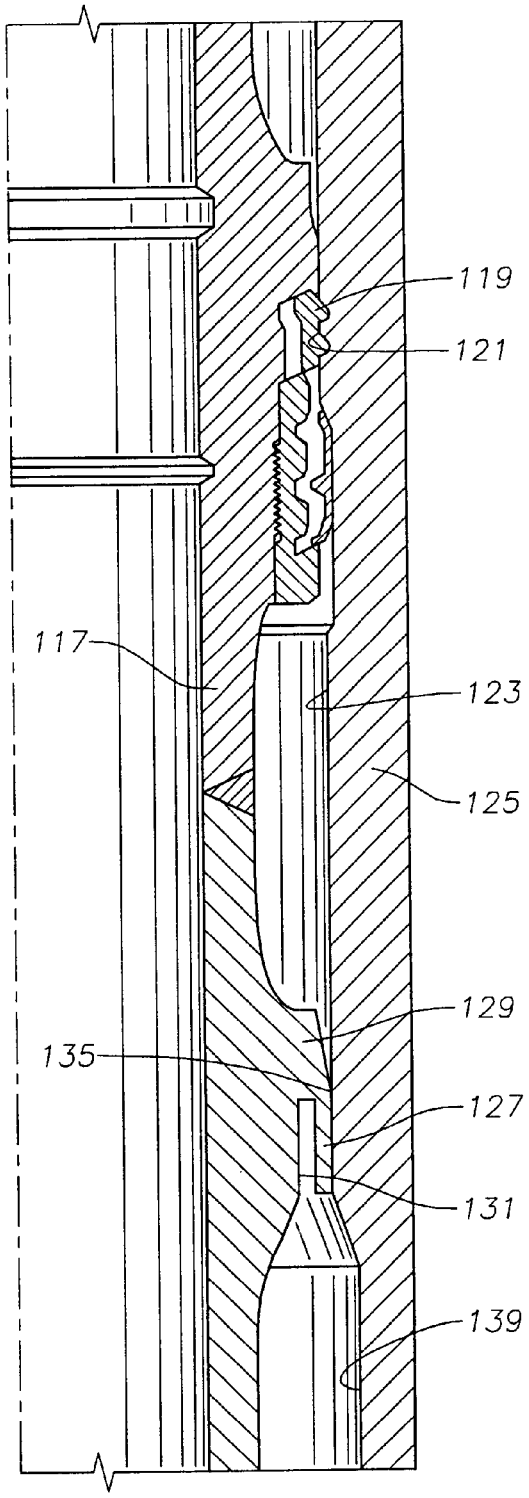
FIG. 11 is a cross-sectional view of a third embodiment of a connection system in accordance with this invention.
Figure 12:
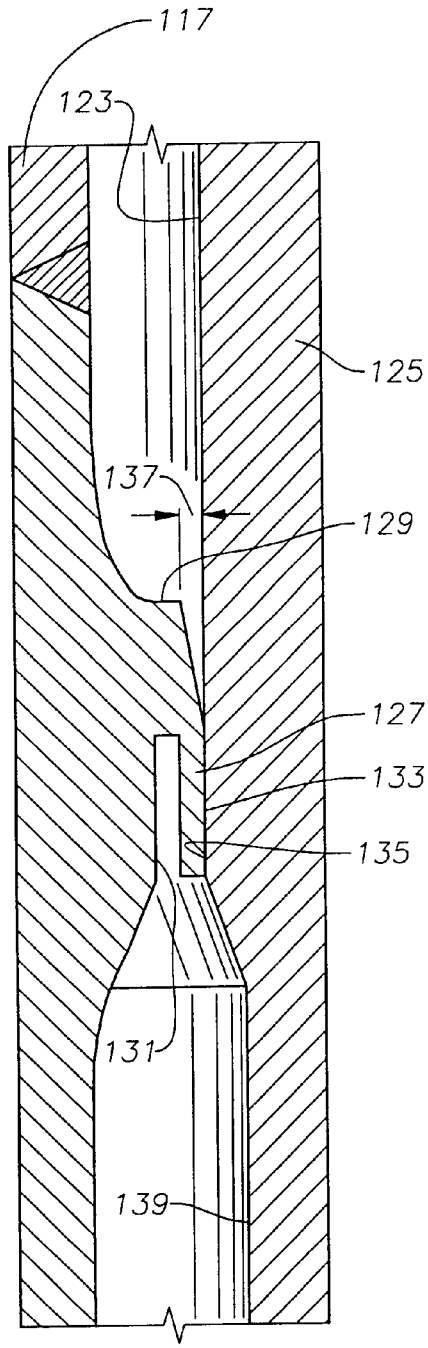
FIG. 12 is a partial enlarged cross-sectional view of the connection system of FIG. 11.

In the embodiment of FIGS. 11 and 12, the radial preload mechanism is passive, not utilizing any actuators. Hanger 117 is supported in the same manner as the other embodiments, having a latch 119 that engages receptacle grooves 121. Grooves 121 are formed in bore 123 of receptacle 125. A lip 127 is formed on a shoulder 129 of hanger 117. Lip 127 depends downward and is spaced from outer surface 131 of hanger 117 by an annular cavity. The outer surface 133 of lip 127 engages in radial interference an internal shoulder 135 formed in receptacle bore 123. Shoulder 137 has a lesser radial dimension that the diameter of bore 123 above shoulder 137, as indicated by dimension 137. Shoulder 137 has a tapered upper surface that increases in diameter in an upward direction back to the nominal dimension of receptacle bore 123. Shoulder 137 also has a tapered lower surface that increases in diameter in a downward direction to a counterbore 139 of larger diameter than the upper portion of bore 123.

In a natural undeflected condition, the outer radial dimension of lip outer surface 131 is greater than the inner diameter of shoulder 135. As hanger 117 is pulled into receptacle 125, lip 127 will deflect radially inward, creating a radial preload force. The amount of deflection is elastic, not permanent.

The invention has significant advantages. Preloading the hanger against the receptacle helps resist fatigue due to wave and current movement of the platform relative to the riser, whether the preloading is axial or radial.

While the invention has been shown in only one of its forms, it should be apparent to those skilled in the art that it is not so limited, but is susceptible to various changes without departing from the scope of the invention. For example, different load supporting mechanisms may be used to support the hanger in the receptacle. The riser hanger grooves could comprise a single upward facing shoulder. The riser hanger grooves could comprise a retractable shoulder, allowing the latch on the riser hanger to be a simple downward facing shoulder, rather than a retractable member. Similarly, a single downward facing shoulder could be substituted for the tieback grooves in the receptacle. This shoulder could also be configured to be retractable. Also, rather than segments or dogs, a single split ring could be employed. The axial preload force could pass through a lower end of the outer member into the hanger body rather than into the rim of the hanger body. Threaded engagement and rotary movement to axially preload could be changed to a straight downward action of a cam member employing hydraulic cylinders or other drive mechanisms. The radial preloading of the second embodiment can be accomplished by devices other than a hydraulic cylinder, such as a screw jack. The system may be employed with other types of subsea riser connections rather than a catenary riser.

We claim:

1. An apparatus for conveying fluids from a subsea location to a surface platform, comprising:

a receptacle adapted to be mounted to a platform;

a riser assembly that extends into the receptacle;

a latch member that latches the riser assembly to the receptacle as the riser assembly enters the receptacle to cause the receptacle to support the weight of the riser assembly; and a preload member mounted to the riser assembly, the preload member contacting the receptacle and exerting a preload force on the riser assembly.

2. The apparatus according to claim 1, wherein the preload member is mounted to the riser assembly above the latch member and exerts a downward preload force on the latch member.

3. The apparatus according to claim 1, wherein the preload member is mounted to the riser assembly below the latch member and exerts a radial preload force between the riser assembly and the receptacle.

4. The apparatus according to claim 1, wherein the preload member comprises:

a downward facing lip formed on an exterior of the riser assembly below the latch member; and a wedging block mounted to the riser assembly below the latch member for axial movement between an engaged position wedging the lip radially outward into engagement with the receptacle and a disengaged position.

5. The apparatus according to claim 4, further comprising:

a hydraulic cylinder for moving the block to the engaged position.

6. The apparatus according to claim 1, wherein the preload member comprises:

a downward extending lip mounted on the riser assembly below the latch member, the lip engaging an inside surface of the receptacle in interference engagement, causing the lip to radially deflect.

7. An apparatus for supporting a subsea riser at a surface platform, comprising:

a receptacle adapted to be mounted to a platform, the receptacle having a generally downward facing upper shoulder and a generally upward facing lower shoulder therein;

a hanger adapted to be connected to the subsea riser, the hanger having a supporting shoulder that engages the lower shoulder to resist downward pull of the riser;

an upper member that lands in the receptacle above and in contact with the riser;

a latch carried by the upper member that engages the upper shoulder to prevent upward movement of the upper member; and the upper member having a tensioner that cooperates with the latch to exert a downward preload force on the supporting shoulder of the hanger.

8. The apparatus according to claim 7, wherein the upper member comprises:

an outer member that carries the latch and lands on the hanger; and wherein the tensioner comprises:

an inner member that is carried in the outer member; and a locking surface on the inner member that cooperates with a locking surface on the latch to exert an outward force on the latch and a downward force on the outer member as the inner member is moved downward relative to the outer member.

9. The apparatus according to claim 7, wherein the upper member comprises:

an outer member that carries the latch and lands on the hanger; and wherein the tensioner comprises:

an inner member that is carried in the outer member; and a set of threads on the inner member that engages a set of threads on the latch to exert an outward force on the latch and a downward force on the outer member as the inner member is rotated relative to the outer member.

10. The apparatus according to claim 7, wherein the upper member comprises:

an annular outer member that carries the latch and lands on the hanger;

a tubular inner member adapted to be joined to a conduit extending upward from the inner member, the inner member being located in the outer member and having a bore that is substantially the same diameter as a bore of the hanger, the hanger having an internal shoulder in the bore of the hanger that is located adjacent a lower end of the inner member; and a seal that extends between the lower end of the inner member and the bore of the hanger.

11. The apparatus according to claim 7, wherein the supporting shoulder of the hanger comprises a locking member that is outward biased.

12. The apparatus according to claim 7, wherein the upper and lower shoulders in the receptacle comprise grooved profiles.

13. The apparatus according to claim 7, wherein the latch comprises:

a split ring: and a plurality of segments on an outer diameter of the ring.

14. The apparatus according to claim 7, wherein the latch comprises:

a split ring: and a plurality of segments carried on an outer diameter of the ring for radial movement relative to the receptacle; and wherein the tensioner comprises:

a set threads on an outer diameter of the ring; and an inner member that has a conical surface with a set of threads that engage the threads on the ring, so that rotational movement of the inner member advances the threads and moves the ring and segments radially outward.

15. An apparatus for supporting an upper end of a subsea riser at a surface platform, comprising:

a receptacle adapted to be mounted to a platform, the receptacle having upper and lower grooved profiles therein;

a hanger adapted to be connected to the upper end of a riser;

a hanger latch that engages the lower grooved profile in the receptacle to resist downward pull of the riser;

an outer member that lands on the hanger;

an outer member latch carried by the outer member that engages the upper grooved profile;

an inner member that is carried in the outer member; and a locking surface on the inner member that cooperates with a locking surface on the outer member latch to exert an outward force on the outer member latch, the engagement of the latch with the upper grooved profile creating a downward force on the outer member as the inner member is moved downward relative to the outer member.

16. The apparatus according to claim 15, wherein the locking surfaces comprise threads.

17. The apparatus according to claim 15, wherein the outer member latch comprises:

a split ring having an outer diameter and an inner diameter; and a plurality of segments carried on the outer diameter of the ring for radial movement relative to the outer member between engaged and disengaged positions with the upper grooved profile in the receptacle; and wherein the locking surfaces comprise:

a set of threads on the inner diameter of the ring; and a set of threads on an outer diameter of the inner member.

18. The apparatus according to claim 15, wherein the locking surface on the outer member latch comprises a conical annular inner surface, and the locking surface on the inner member comprises a mating conical outer surface.

19. The apparatus according to claim 15, wherein outer member latch comprises:

a split ring having an outer surface; and a plurality of segments carried on the outer surface of the ring for radial movement relative to the outer member between engaged and disengaged positions with the upper grooved profile in the receptacle; and wherein the locking surfaces comprise:

a tapered inner surface on the ring having a set of threads; and a tapered outer surface on the inner member having a set of threads.

20. The apparatus according to claim 15, wherein the inner member is adapted to be joined to a conduit extending upward from the inner member, the inner member having a bore that is substantially the same diameter as a bore of the hanger, the hanger having an internal shoulder in the bore of the hanger that is located adjacent a lower end of the inner member; and wherein the apparatus further comprises:

a seal that extends between the lower end of the inner member and the bore of the hanger.

21. An apparatus for supporting an upper end of a subsea riser on a surface platform, comprising:

a receptacle adapted to be mounted to a platform, the receptacle having upper and lower grooved profiles therein;

a hanger adapted to be connected to the upper end of a subsea riser;

a hanger latch that is outward biased and which engages the lower grooved profile in the receptacle to resist downward pull of the riser;

an outer member that has a generally downward facing shoulder that lands on the hanger;

an outer member latch carried by the outer member, the outer member latch having an outer portion that engages the upper grooved profile and an inner portion having an inner surface containing a set threads formed along a tapered surface;

an inner member that is carried in the outer member, the inner member having a set of threads on a tapered outer surface portion of the inner member that engages the set of threads on the inner portion of the outer member latch to exert an outward force on the outer member latch as the inner member is rotated relative to the outer member; and the outer member latch being dimensioned to be located slightly out of alignment with the upper grooved profile when the outer member initially lands on the hanger, so that outward movement into the upper grooved profile causes a downward preload force to be exerted through the outer member, hanger and hanger latch into the receptacle.

22. The apparatus according to claim 21, wherein the hanger has an upper rim onto which the outer member lands.

23. The apparatus according to claim 21, wherein the inner member is adapted to be joined to a conduit extending upward from the inner member, the inner member having a bore that is substantially the same diameter as a bore of the hanger, the hanger having an internal shoulder in the bore of the hanger that is located adjacent a lower end of the inner member; and wherein the apparatus further comprises:

a seal that extends between the lower end of the inner member and the bore of the hanger.

24. An apparatus for supporting a subsea riser at a surface platform, comprising:

a receptacle adapted to be mounted to a platform, the receptacle having a generally upward facing load shoulder;

a hanger adapted to be connected to a subsea riser;

a supporting shoulder carried by the hanger that engages the load shoulder to resist downward pull of the riser; and a downward extending lip mounted to an exterior surface of the hanger below the supporting shoulder, the lip being spaced radially outward from the exterior surface and engaging an inside surface of the receptacle in radial interference fit.

25. The apparatus according to claim 24, further comprising:

a wedge member mounted to the hanger for axial movement relative to the riser between an engaged position wedging between the lip and the exterior surface of the riser and a disengaged position.

26. The apparatus according to claim 25, further comprising:

a rod extending downward from the wedge member; and a jack mechanism connected between the rod and the hanger for moving the rod axially to move the wedge member between the engaged and disengaged positions.

27. The apparatus according to claim 25, further comprising:

a rod extending downward from the wedge member; and a hydraulic cylinder assembly connected between the rod and the hanger for moving the rod axially to move the wedge member between the engaged and disengaged positions.

28. The apparatus according to claim 24, wherein the lip has an outer surface with an undeflected radial dimension that is greater than an inner diameter of the receptacle for engaging the receptacle in interference fit as the hanger is moved into the receptacle.

29. A method of connecting a riser assembly to a floating platform, comprising:

(a) providing a receptacle on the platform;

(b) latching the riser assembly to the receptacle at a first point, thereby resisting downward pull by the riser assembly; and (c) applying a radial force between the riser assembly and the receptacle at a second point spaced axially from the first point to resist movement of the riser assembly relative to the receptacle.

30. The method according to claim 29, wherein step (b) comprises providing the receptacle with a grooved profile and providing a radially movable outward biased latch on the riser, then pulling the riser upward relative to the receptacle until the latch springs into engagement with the grooved profile.

31. The method according to claim 29, wherein step (c) comprises exerting the radial force in outward directions.

32. The method according to claim 29, wherein step (c) comprises:

providing a downward extending lip on an exterior of the riser assembly below the first point; and forcing the lip into radial engagement with the receptacle, causing the lip to deflect and exert the radial force.

33. The method according to claim 32, further comprising:

pushing a wedging block between the lip and the receptacle to push the lip radially outward.

34. A method of connecting a subsea riser to a surface platform, comprising:

(a) providing a receptacle on the platform with a generally upward facing lower shoulder and with a generally downward facing upper shoulder;

(b) securing a hanger to an upper end of the riser and landing the hanger on the lower shoulder, thereby resisting downward pull by the riser;

(c) providing an upper member with a latch, inserting the upper member into the receptacle into contact with the hanger and engaging the upper shoulder with the latch to prevent upward movement of the upper member in the receptacle; then (d) applying a downward preload force on the upper member and through the upper member and hanger to the lower shoulder, the downward preload force being reacted through the latch against the upper shoulder.

35. The method according to claim 34, wherein step (d) comprises:

providing the upper member with an outer member and an inner member and moving the inner member downward relative to the outer member.

36. The method according to claim 34, wherein step (d) comprises:

providing the latch with an inner surface containing a set of threads, and providing the upper member with an outer member and inner member, the inner member having an outer surface containing a set of threads in engagement with the set of threads of the latch; then rotating the inner member relative to the latch and the outer member, causing the inner member to move downward relative to the outer member.

37. The method according to claim 34, further comprising providing the upper member with a bore that has a diameter the same as a diameter of the hanger, and inserting a seal between a lower end of the bore of the upper member and an upper end of the bore of the hanger.

38. In a floating platform having a hull with an opening therein, an apparatus for conveying fluids from a subsea location to the surface platform, comprising:

a receptacle mounted within the opening in the hull of the platform;

a riser assembly having a lower end adapted to be connected to the subsea location and an upper end extending into the receptacle;

a latch member that engages the riser assembly with the receptacle and transfers the weight of the riser assembly to the receptacle and the hull of the platform; and a radial force member exerting a radial force between the riser assembly and the receptacle at a point axially spaced from the latch member.

39. The platform according to claim 38, wherein the latch member is spring-biased.

* * * * *

UNITED STATES PATENT AND TRADEMARK OFFICE

CERTIFICATE OF CORRECTION

PATENT NO. : 6,536,527 B2
DATED : March 25, 2003
INVENTOR(S) : Brian N. Munk et al.

It is certified that error appears in the above-identified patent and that said Letters Patent is hereby corrected as shown below:

Title page,
Item [57], ABSTRACT,
Line 12, delete the "," (comma) after "latch" and insert a -- . -- (period);
Line 12, delete "rotating" and insert -- Rotating --

Column 1,
Line 60, delete "that" after "preload"

Column 6,
Line 9, delete "surround" and insert -- surrounding --

Column 9,
Line 46, after "a set" insert -- of --

Signed and Sealed this

Eighth Day of July, 2003

JAMES E. ROGAN
*Director of the United States Patent and Trademark Office*